US005263830A

United States Patent [19]

Goi et al.

[11] Patent Number: 5,263,830

[45] Date of Patent: Nov. 23, 1993

[54] PERISTALTIC PUMP ASSEMBLY

[75] Inventors: Nobuaki Goi, Yamatokoriyama, Japan; Charles Tseng, Lake Bluff, Ill.; Roberta Scola, Roselle, Ill.; Eric Myren, Barrington, Ill.; Dan Hamilton, Hoffman Eastates, Ill.

[73] Assignees: Sharp Kabushiki Kaisha, Osaka, Japan; Baxter International Inc., Deerfield, Ill.

[21] Appl. No.: 29,960

[22] Filed: Mar. 9, 1993

Related U.S. Application Data

[63] Continuation of Ser. No. 823,369, Jan. 21, 1992, abandoned.

[30] Foreign Application Priority Data

Jan. 23, 1991 [JP] Japan ..... 3-006239

[51] Int. Cl.[5] ..... F04B 43/12

[52] U.S. Cl. ..... 417/474; 92/13

[58] Field of Search ..... 417/474–478; 92/13, 13.2, 13.7

[56] References Cited

U.S. PATENT DOCUMENTS

| | | | |
|---|---|---|---|
| 2,412,397 | 12/1946 | Harper | 417/474 |
| 2,877,714 | 3/1959 | Sorg | 417/474 |
| 3,427,986 | 2/1969 | Corneil | 417/474 |
| 3,433,171 | 3/1969 | Corneil | 417/474 |
| 3,778,195 | 12/1973 | Bamberg | 717/474 |
| 4,617,014 | 10/1986 | Cannon et al. | 604/604 |
| 4,690,673 | 9/1987 | Bloomquist | 604/604 |
| 4,952,124 | 8/1990 | Ogami | 417/604 |

FOREIGN PATENT DOCUMENTS 61-228872 1/1985 Japan .

*Primary Examiner*—Richard A. Bertsch
*Assistant Examiner*—Peter Korytnyk
*Attorney, Agent, or Firm*—Nixon & Vanderhye

[57] ABSTRACT

A peristaltic pump assembly for pumping a fluid medium from a fluid source through a tubing having a compressible pumping section, which assembly comprises a housing including at least one support wall; a drive shaft journalled substantially loosely to the support wall; a plurality of cam plates eccentrically mounted on the drive shaft in a helical pattern along the drive shaft and rotatable together with the drive shaft for, during a rotation of the drive shaft, driving finger plates sequentially in a direction perpendicular to the drive shaft to cause respective finger tips of the finger plates to engage the pumping section thereby producing a moving zone of occlusion along the pumping section for pumping the fluid medium; and an adjustment mechanism mounted on the support wall for adjustably displacing the drive shaft together with the cam plates and the finger plates in a direction perpendicular thereto. The adjustment mechanism comprises a shaft bearing plate mounted on the support wall for movement in a linear direction parallel to the direction of movement of each finger plate and through which the drive shaft extends rotatably, and a drive member for adjustably moving the bearing plate in the linear direction.

10 Claims, 4 Drawing Sheets

PERISTALTIC PUMP ASSEMBLY

This is a continuation of application Ser. No. 07/823,369, filed Jan. 21, 1992, now abandoned.

BACKGROUND OF THE INVENTION

1. Field of the Invention

The present invention generally relates to an infusion device suited, but not exclusively limited thereto, for the infusion of medical solutions to a patient. More specifically, the present invention relates to a peristaltic infusion pump utilizing the peristaltic action to accomplish a pumping of a fluid medium through a flexible and compressible tubing.

2. Description of the Prior Art

An example of prior art peristaltic pump assemblies is schematically shown in FIGS. 6 to 8 of the accompanying drawings. FIG. 6 is a schematic top plan view of the prior art peristaltic pump assembly; FIG. 7 is a schematic side view as viewed in a direction perpendicular to a drive shaft 3, showing a portion of the housing; and FIG. 8 is a schematic cross-sectional view, on an enlarged scale, taken along the line C—C in FIG. 6.

The illustrated peristaltic pump assembly comprises a housing including at least top and bottom walls 1*a* and 1*b* connected together so as to define a cam chamber therebetween. A drive shaft 3 having one end drivingly coupled with any suitable drive motor, for example, a stepper motor, extends rotatably, but axially non-movably through associated annular bearings 2 mounted on those walls 1*a* and 1*b* in any known manner. A plurality of round cam plates 4 are situated within the cam chamber between the top and bottom walls 1*a* and 1*b* and are rigidly mounted on the drive shaft 3 for rotation together therewith. Generally rectangular finger plates 5 equal in number to the number of the cam plates 4 are also operatively accommodated within the cam chamber, each of said finger plates 5 having an aperture defined therein to accommodate the associated cam plate 4. As will become clear from the subsequent description, each of the finger plates 5 is movable between retracted and projected positions in a direction perpendicular to the drive shaft 3 during the rotation of the drive shaft 3 and, hence, that of the associated cam plate 4.

A stationary back-up plate 6 is positioned parallel to the drive shaft 3 and in the vicinity of the projected position of each finger plate 5 with a flexible and compressible infusion tubing 7 extending therebetween. This infusion tubing 7 has an upper end fluid-connected with a well-known source of infusion solution (not shown) and a lower end fluid-connected with an injection needle or a infusion catheter (not shown) and then to a patient. For the purpose of discussion, a portion of the infusion tubing 7 between a finger tip 5*a* of one of the finger plates 5 closest to the top wall 1*a* and a finger tip 5*a* of another one of the finger plates 5 closest to the bottom wall 1*b* and along the stationary back-up plate 6 is hereinafter referred to a pumping section of the infusion tubing 7.

As best shown in FIGS. 6 and 8, the round cam plates 4 are eccentrically mounted on the drive shaft 3 along the longitudinal axis of the drive shaft 3 in a manner which will create a peristaltic action by the movement of finger plates 5 as will be described later. With the round cam plates 4 so mounted eccentrically on the drive shaft 3, each round cam plate 4 generally has protruding and retracting lobes opposite to each other with respect to the axis of the drive shaft 3, the protruding lobe representing a maximum radius $a_1$ radially away from the axis of the drive shaft 3 while the retracting lobe represents a minimum radius $a_2$ radially away from the axis of the drive shaft 3 as shown in FIG. 8. These cam plates 4 are so eccentrically mounted on the drive shaft 3 for rotation together therewith that the respective protruding lobes will be sequentially displaced an angle of n/360 degree about the axis of the drive shaft 3 from each other in a direction circumferentially of each cam plate 4, wherein n represents the number of the cam plates 4. As illustrated in FIG. 8, eight cam plates 4 are employed and, hence, the respective protruding cam lobes are circumferentially displaced 45 degrees about the axis of the drive shaft 3. In any event, the round cam plates 4 are eccentrically mounted on the drive shaft 3 in a helical pattern along the axis of the drive shaft 3.

Each of the apertures defined in the finger plates 5 and operatively accommodating therein the respective cam plates 4 is so shaped and so sized that, during one complete rotation of the associated cam plate 4 together with the drive shaft 3, the respective finger plate 5 can be driven or slid reciprocally between the projected and retracted position in a linear direction perpendicular to the axis of the drive shaft 3. Therefore, the rotation of the cam plates 4 together with the drive shaft 3 and within the apertures in the associated finger plates 5 causes the respective finger plates 5 to sequentially move between the projected and retracted positions thereby creating a peristaltic action by which the pumping section of the tubing 7 are progressively squeezed by the respective finger tips 5*a* of the finger plates 5 in cooperation with the stationary back-up plate 6 to accomplish a continuous volumetric displacement of the infusion solution through the pumping section of the infusion tubing 7.

The foregoing example of the prior art peristaltic pump assembly is substantially disclosed in, for example, U.S. Pat. Nos. 4,617,673, issued Oct. 14, 1986; 4,690,673, issued Sep. 1, 1987; and 4,952,124, issued Aug. 28, 1990, and U.S. patent application Ser. No. 07/513,886, filed Apr. 24, 1990 now abandoned.

Briefly speaking, the prior art peristaltic pump assembly of the type referred to above is of a design wherein the finger plates 5 successively driven by the cam plates 4 sequentially squeeze the pumping section of the infusion tubing 7 while producing a zone of occlusion that is progressively moving along said pumping section in a direction conforming to the direction of flow of the infusion solution.

When it comes to a mass production of the peristaltic pump assemblies with a view that the resultant products can be made available at a reduced price, any dimensional deviation among the component parts of identical design and/or shape used in one or more lots of the peristaltic pump assemblies may cause the pump assemblies of the different lots to exhibit a different pumping performance, for example, a different pumping rate. By way of example, the illustrated peristaltic pump assembly employs one or more groups of component parts of identical design and/or shape such as a group of the cam plates 4 and a group of the finger plates 5. If one lot of the cam plates and another lot of the cam plate have a dimensional deviation from each other, not only may the single peristaltic pump assembly exhibit a fluid pumping rate deviating from the design parameter if such single peristaltic pump assembly employs the cam plates selected from these different lots of cam plates, but the peristaltic pump assemblies of one batch may also exhibit a fluid pumping rate varying from that of the peristaltic pump assemblies of a different batch.

Let it be assumed that there are patients who require an equal quantity of the same infusion solution to be injected, the use of the peristaltic pump assemblies of varying pumping performance may result in the injection of the correspondingly varying quantities of the infusion solution into the respective patients and/or in that the quantity of the infusion solution actually injected may vary from that specified by a doctor or an attendant nurse. This is not desirable and should be minimized or substantially eliminated.

SUMMARY OF THE INVENTION

Accordingly, the present invention has been devised with a view to substantially eliminating the above discussed problems inherent in the prior art peristaltic pump assemblies and has for its essential object to provide an improved peristaltic pump assembly capable of accommodating any possible deviation in dimension, shape and/or profile of some component parts of identical design.

To this end, the present invention provides a peristaltic pump assembly for pumping a fluid medium from a fluid source through a tubing having a compressible pumping section, which assembly comprises a housing including at least one support wall; a drive shaft journalled substantially loosely to the support wall; a plurality of cam plates eccentrically mounted on the drive shaft in a helical pattern along the drive shaft and rotatable together with the drive shaft for, during a rotation of the drive shaft, driving finger plates sequentially in a direction perpendicular to the drive shaft to cause respective finger tips of the finger plates to engage the pumping section thereby producing a moving zone of occlusion along the pumping section for pumping the fluid medium; and an adjustment mechanism mounted on the support wall for adjustably displacing the drive shaft together with the cam plates and the finger plates in a direction perpendicular thereto.

The adjustment mechanism comprises a shaft bearing plate mounted on the support wall for movement in a linear direction parallel to the direction of movement of each finger plate and through which the drive shaft extends rotatably, and a drive means for adjustably moving the bearing plate in the linear direction.

According to the present invention, if a gap between the finger tip of any one of the finger plates, when it is driven to a projected position to create the zone of occlusion along the pumping section, and a back-up members is desired to be adjusted, the drive means should be manipulated to move the shaft bearing plate thereby causing the drive shaft together with the cam plates and the finger plates to move. This drive means may comprise a pair of wedge plates disposed on respective sides of the shaft bearing plate, and an adjustment screw member for each of the wedge plates.

Therefore, even though the peristaltic pump assemblies as manufactured and/or assembled have a varying pumping performance, such variation can be compensated for by operating the adjustment mechanism in each of the peristaltic pump assemblies so that they can come to exhibit a uniform pumping performance.

BRIEF DESCRIPTION OF THE DRAWINGS

This and other objects and features of the present invention will readily become apparent from the following description taken in conjunction with a preferred embodiment thereof with reference to the accompanying drawings, in which.

DETAILED DESCRIPTION OF THE EMBODIMENT

Figure 1:
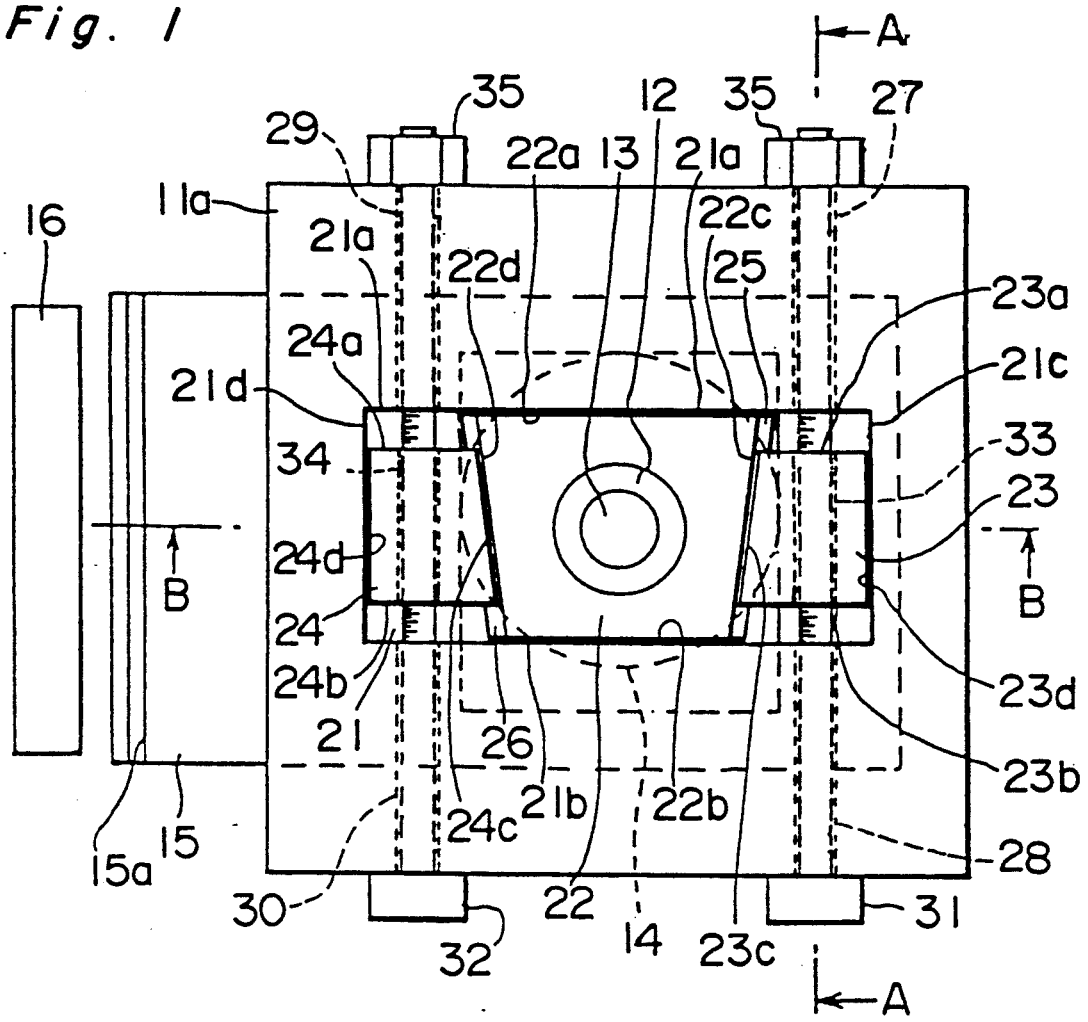
FIG. 1 is a schematic top plan view, on an enlarged scale, of a peristaltic pump assembly embodying the present invention.
Figure 2:
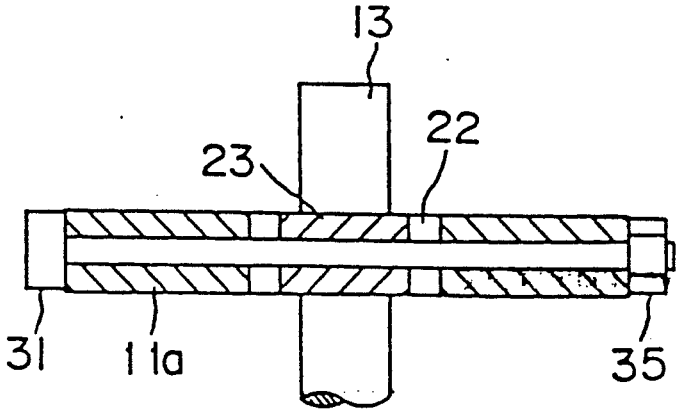
FIG. 2 is a cross-sectional view taken along the line A—A in FIG. 1, showing only a top wall of the housing for the peristaltic pump assembly.
Figure 3:
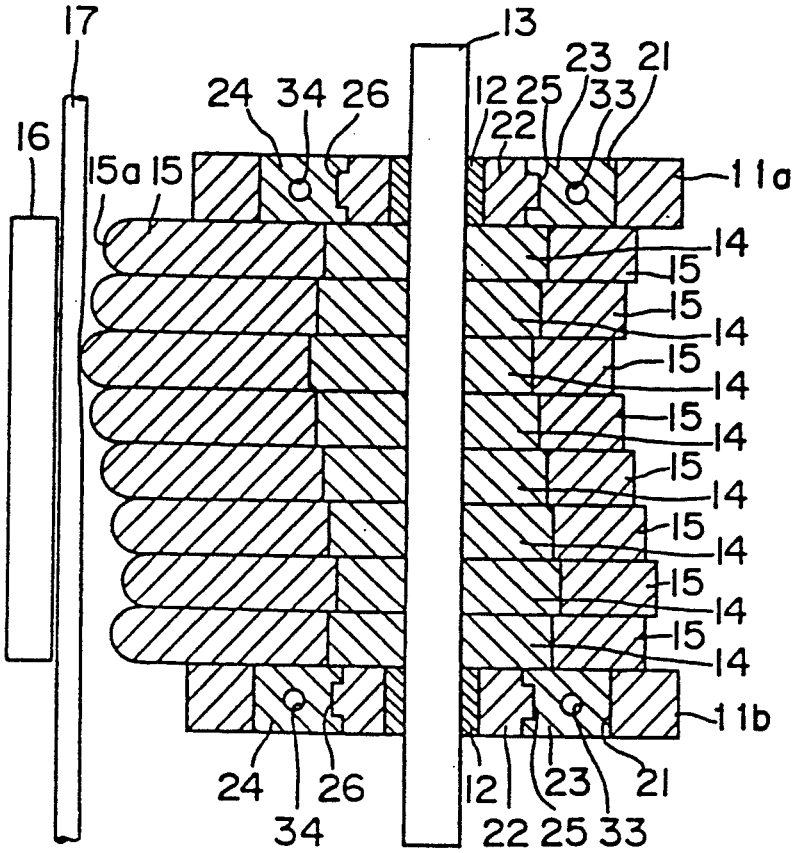
FIG. 3 is a cross-sectional view taken along the line B—B in FIG. 1, showing an arrangement of cam plates and finger plates within the pump assembly housing.

Referring to FIGS. 1 to 5 and particularly to FIGS. 1 to 3, a peristaltic pump assembly embodying the present invention comprises a housing including at least top and bottom walls 11*a* and 11*b* spaced apart from each other and connected together so as to define a cam chamber therebetween. A drive shaft 13 having one end drivingly coupled with any suitable drive motor (not shown), for example, a stepper motor, extends rotatably, but axially non-movably through associated annular bearings 12 mounted on those walls 11*a* and 11*b* operatively accommodated respectively in the top and bottom walls 11*a* and 11*b* in a manner as will be described later.

A plurality of round cam plates 14 are situated within the cam chamber between the top and bottom walls 11*a* and 11*b* and are rigidly mounted on the drive shaft 13 for rotation together therewith. Generally rectangular finger plates 15 equal in number to the number of the cam plates 14 are also operatively accommodated within the cam chamber, each of said finger plates 15 having an aperture defined therein to accommodate the associated cam plate 14. Each of the finger plates 15 is movable between retracted and projected positions in a direction perpendicular to the drive shaft 13 during the rotation of the drive shaft 3 and, hence, that of the associated cam plate 14.

A stationary back-up plate 16 is positioned parallel to the drive shaft 13 and in the vicinity of the projected position of each finger plate 15 with a flexible and compressible infusion tubing 17 extending therebetween. This infusion tubing 17 has an upper end fluid-connected with a well-known source of infusion solution (not shown) and a lower end fluid-connected with an injection needle or a infusion catheter (not shown) and then to a patient. For the purpose of discussion, a portion of the infusion tubing 17 between a finger tip 15*a* of one of the finger plates 15 closest to the top wall 11*a* and a finger tip 15*a* of another one of the finger plates 15 closest to the bottom wall 11*b* and along the stationary back-up plate 16 is hereinafter referred to a pumping section of the infusion tubing 17.

The round cam plates 14 are eccentrically mounted on the drive shaft 13 along the longitudinal axis of the drive shaft 13 in a manner which will create a peristaltic action by the movement of the finger plates 15 as will be described later. With the round cam plates 14 so mounted eccentrically on the drive shaft 13, each round cam plate 14 generally has protruding and retracting lobes opposite to each other with respect to the axis of the drive shaft 13, the protruding lobe representing a maximum radius radially away from the axis of the drive shaft 13 while the retracting lobe represents a minimum radius radially away from the axis of the drive shaft 13. These cam plates 14 are so eccentrically mounted on the drive shaft 13 for rotation together therewith that the respective protruding lobes will be sequentially displaced an angle of n/360 degree about the axis of the drive shaft 13 from each other in a direction circumferentially of each cam plate 14, wherein n represents the number of the cam plates 14. As illustrated in FIG. 3, eight cam plates 14 are employed and, hence, the respective protruding cam lobes are circumferentially displaced 45 degrees about the axis of the drive shaft 13. In any event, the round cam plates 14 are eccentrically mounted on the drive shaft 13 in a helical pattern along the axis of the drive shaft 13.

Each of the apertures defined in the finger plates 15 and operatively accommodating therein the respective cam plates 14 is so shaped and so sided that, during one complete rotation of the associated cam plate 14 together with the drive shaft 13, the respective finger plate 15 can be driven or slid reciprocally between the projected and retracted position in a linear direction perpendicular to the axis of the drive shaft 13. Therefore, the rotation of the cam plates 14 together with the drive shaft 13 and within the apertures in the associated finger plates 15 causes the respective finger plates 15 to sequentially move between the projected and retracted positions thereby creating a peristaltic action by which the pumping section of the tubing 17 are progressively squeezed by the respective finger tips 15*a* of the finger plates 15 in cooperation with the stationary back-up plate 16 to accomplish a continuous volumetric displacement of the infusion solution through the pumping section of the infusion tubing 17.

Figure 6:
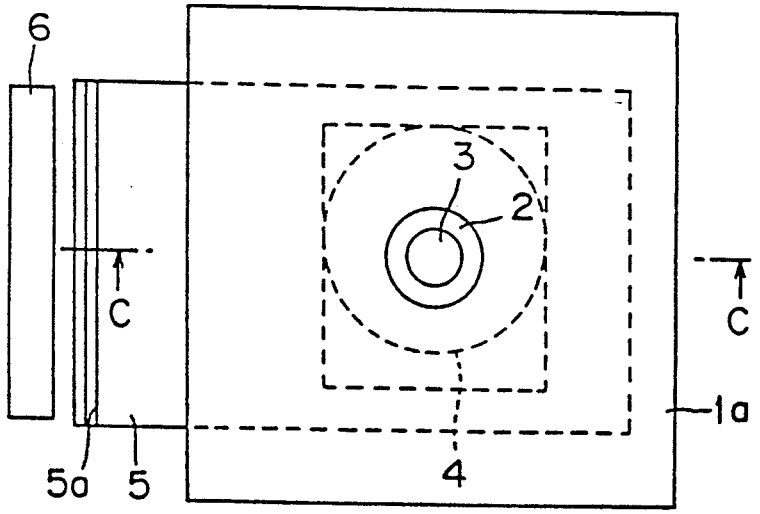
Fig. 6 Prior Art
FIG. 6 is a schematic top plan view of the prior art peristaltic pump assembly.
Figure 7:
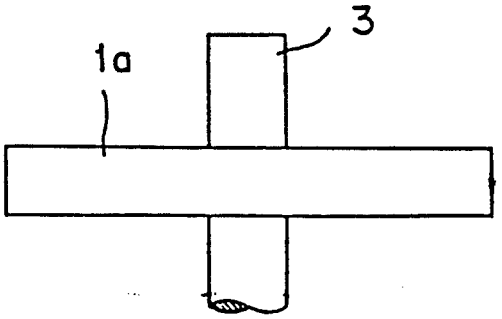
Fig. 7 Prior Art
FIG. 7 is a lateral side view of the top wall of the housing for the peristaltic pump assembly shown in FIG. 6.
Figure 8:
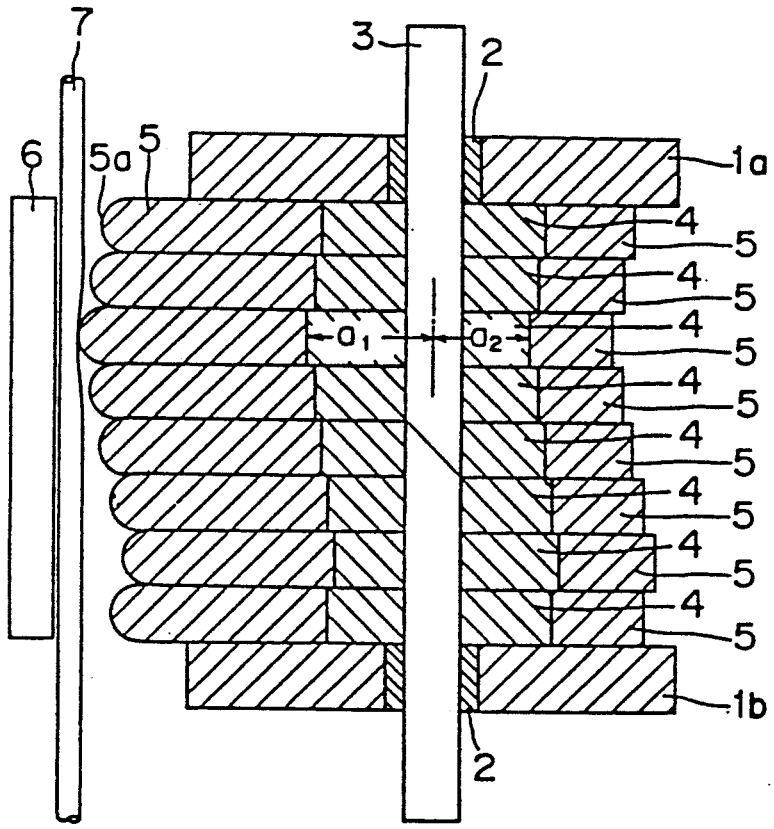
Fig. 8 Prior Art
FIG. 8 is a cross sectional view taken along the line C—C in FIG. 6.

In any event, the peristaltic pump assembly so far described is substantially identical in construction with the prior art peristaltic pump assembly shown in and described with reference to FIGS. 6 to 8. However, in accordance with the present invention, a unique design has been made to allow the drive shaft to displace in a direction perpendicular to the back-up plate 16 and also conforming to the direction of movement of each finger plate 15 so that the plural peristaltic pump assemblies manufactured or assembled while embodying the present invention can be adjusted to exhibit a uniform pumping performance.

As best shown in FIGS. 1 and 3, each of the top and bottom walls 11*a* and 11*b* of the housing for the peristaltic pump assembly has a generally rectangular opening 21 defined therein, having its longitudinal sense oriented in a direction parallel to the direction of movement of each finger plate 15. This rectangular opening 21 is delimited by a pair of long side lips 21*a* and 21*b* and a pair of short side lips 21*c* and 21*d*. An adjustment mechanism for adjustably displacing the drive shaft 13 in a direction parallel to the direction of movement of each finger plate 15 and perpendicular to the back-up plate 16 is operatively accommodated within the rectangular opening 21 defined in each of the top and bottom walls 11*a* and 11*b*, the details of which will subsequently be described. It is, however, to be noted that, since the adjustment mechanisms within the respective rectangular openings 21 are of identical construction, reference will be made to only one of the adjustment mechanisms, that is, the adjustment mechanism accommodated within the rectangular opening 21 in the top wall 11*a* for the sake of brevity.

The adjustment mechanism associated with each of the top and bottom walls 11*a* and 11*b* comprises a generally trapezoidal bearing plate 22 having a long side edge 22*a* of a length smaller than the length of each of the long side lips 21*a* and 21*b*, a short side edge 22*b* parallel to the long side edge 22*a*, and a pair of inclined edges 22*c* and 22*d* each continued at its opposite ends to the long and short side edges 22*a* and 22*b* and inclined an equal angle relative to the longitudinal axis of the rectangular opening 21. This bearing plate 22 carries the corresponding annular bearing 12 for the support of the drive shaft 13 and is displaceable between first and second positions in a direction parallel to the longitudinal axis of the rectangular opening 21.

The adjustment mechanism also comprises first and second positioning wedge plates 23 and 24 movably accommodated within the opening 21 and positioned on respective sides of the bearing plate 22. Each of the wedge plates 23 and 24 is of a shape having a short side edge 23*a* or 24*a* parallel to the long side lip 21*a*, a long side edge 23*b* or 24*b* parallel to the long side lip 21*b*, a transverse edge 23*c* or 24*c* parallel to each short side lip 21*c* or 21*d* and of a length smaller than that of each short side lip 12*c* or 12*d*, and an inclined edge 23*c* or 24*d*.

The bearing plate 22 has guide protuberances 25 and 26 protruding outwardly from the inclined edges 22*c* and 22*d* thereof and extending a distance equal to the length of the associated inclined edges 22*c* and 22*d*. On the other hand, each of the first and second wedge plates 23 and 24 has a guide groove defined in the associated inclined edge 23*c* or 24*c* and extending a distance equal to the length of such associated inclined edge 23*c* or 24*c*. As best shown in FIG. 3, in an assembled condition, the first and second wedge plates 23 and 24 are positioned within the opening 21 on respective sides of the bearing plate 22 with the guide protuberances 25 and 26 slidably engaged in the associated guide grooves in the inclined edges 23*c* and 24*c* of the respective first and second wedge plates 23 and 24.

With all of the plates 22, 23 and 24 so mounted as hereinabove described, care must be taken that, regardless of the position of any one of the bearing plate 22 and the first and second wedge plates 23 and 24 within the opening 21, the sum of the respective lengths of the first and second wedge plates 23 and 24 plus the length of the bearing plate 22, all as measured along the imaginary line drawn so as to pass through the axis of the drive shaft 23 in a direction parallel to the longitudinal axis of the opening 21 should be equal to or substantially equal to the length of any one of the long side lips 22*a* and 22*b*. Unless this requirement is satisfied, the relative positioning of these plates 22, 23 and 24 would result in a undesirable rattling motion of any one of the plates 22, 23 and 24 within the opening 21 which may in turn result in an undesirable oscillatory motion of the drive shaft 13.

For avoiding any possible separation of any one of the plates 22, 23 and 24 outwardly from the opening 21 and also for enabling any one of the first and second wedge plates 23 and 24 to be adjustable along the associated guide protuberance 25 or 26 of the bearing plate 22, the top wall 11*a* is formed with two pairs of axially aligned bearing holes all extending in a direction perpendicular to the direction of movement of each finger plate 15, the bearing holes 27 and 28 of one pair being axially aligned with each other for accommodating an adjustment bolt member 31 while the bearing holes 29 and 30 of the other pair are axially aligned with each other for accommodating an adjustment bolt members 32. On the other hand, each of the first and second wedge plates 23 and 24 has a threaded bore 33 or 34 defined therein so as to extend parallel to the associated transverse edge 23*d* or 24*d* for threaded engagement with the associated adjustment bolt member 31 or 32.

Each of the adjustment bolt members 31 and 32 extends freely rotatably through the bearing hole 28 or 30, then threadedly through the threaded bore 33 or 34 in the associated wedge plate 23 or 24 and finally freely rotatably through the bearing hole 27 or 29 before it emerges outwardly from the top wall 11*a*. Accordingly, when any one of the adjustment bolt members 31 and 32 is turned in either direction about its own longitudinal axis, the associated wedge plate 23 or 24 can be moved along a substantially intermediate portion of the respective adjustment bolt member 31 or 32, which is situated within the opening 21, to urge the bearing plate 22 in a direction parallel to the longitudinal axis of the opening 21 or perpendicular to the adjustment bolt member 31 or 32. In practice, the adjustment bolt members 31 and 32 are so turned that the associated wedge plates 23 and 24 can be moved in respective directions opposite to each other and also perpendicular to the direction of movement of each finger plate 15 whereby one wedge plate 23 or 24 acts to urge the bearing plate 22 away from the adjacent bolt member 31 or 32 while the other wedge plate 24 or 23 moves so as to accommodate the movement of the bearing plate 22 so urged.

Figure 4:
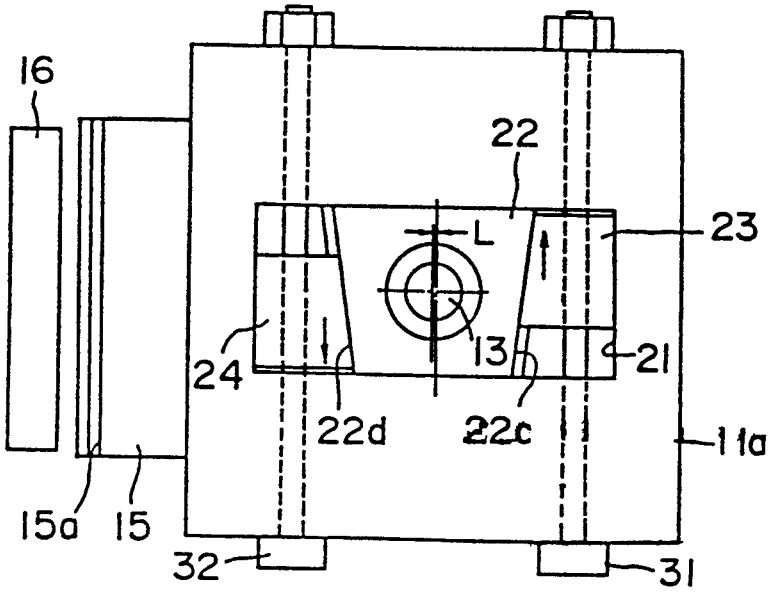
FIGS. 4 and 5 are schematic top plan views of the peristaltic pump assembly showing an adjustment held in different operative positions, respectively.
Figure 5:
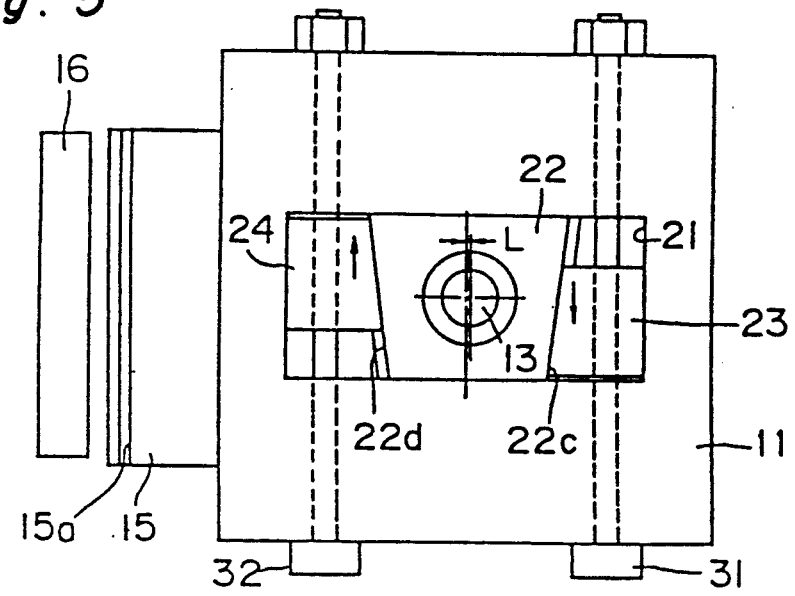

Thus, it will readily be understood that, assuming that. the bearing plate 22 is held at a neutral position as shown in FIGS. 1 and 3, and if the adjustment bolt members 31 and 32 are so turned that the first and second wedge plates 23 and 24 can be moved upwardly and downwardly as indicated by respective arrows in FIG. 4, the bearing plate 22 can be moved a distance L in a direction close towards the back-up plate 16 or leftwards as viewed in FIG. 4. On the other hand, if the adjustment bolt members 31 and 32 are so turned that the first and second wedge plates 23 and 24 can be moved downwardly and upwardly as indicated by respective arrows in FIG. 5, the bearing plate 22 can be moved a distance L in a direction away from the back-up plate 16 or rightwards as viewed in FIG. 5. After this adjustment has been done, the adjustment bolt members 31 and 32 are locked in position by firmly fastening respective lock nuts 35 exteriorly to free ends thereof as best shown in FIG. 1, thereby to avoid any possible loosening of the adjustment bolt member 31 and 32.

The adjustment mechanism of the above detailed design is also employed in the bottom wall 11*b* as best shown in FIG. 3. In other words, so far illustrated, the adjustment mechanism of the above detailed design is accommodated within each of the rectangular openings 21 defined respectively in the top and bottom walls 11*a* and 11*b* of the housing, and the adjustment mechanism in the top wall 11*a* and the adjustment mechanism in the bottom wall 11*b* are operated in the same sense because of a symmetrical disposition with respect to the drive shaft 13. Accordingly, in the event that the distance between the back-up plate 16 and the finger tip 15*a* of each finger plate 15 then held at the projected position is found relatively small or large for a given bore size of the infusion, the adjustment mechanisms should be manipulated to bring the bearing plate 22 towards the first or second positions. As the bearing plates 22 are so moved, the drive shaft 13 is correspondingly displaced close towards or away from the back-up plate 16 together with the cam plates 14 and the associated finger plates 15. Therefore, the distance between the back-up plate 16 and the finger tip 15*a* of each finger plate 12 in the projected position for a given bore size of the infusion tubing 17 can be kept uniformly to a design parameter among the peristaltic pump assemblies embodying the present invention.

It is to be noted that the distance of movement of each bearing plate 22 from the neutral position to any one of the first and second positions may depend on the angle of inclination of both of the inclined edges 22*c* and 22*d* relative to the longitudinal axis of the rectangular opening 21. It is also to be noted that, depending on the size of the peristaltic pump assembly embodying the present invention and/or the rigidity of support of the drive shaft 13 relative to the housing, the adjustment mechanism may not be always provided in each of the top and bottom walls 11*a* and 11*b* of the housing.

As will readily be understood by those skilled in the art, the peristaltic pump assembly according to the present invention may be utilized to adjust the flow of a liquid medium flowing through the tubing 17. This is particularly true where the liquid medium flowing through the tubing 17 is pressurized. In this case, when the adjustment mechanisms are held at the position shown in FIG. 4 with the distance minimized between the back-up plate 16 and the finger tip 15*a* of each finger plate 15 then held at the projected position, the flow rate may be minimized, but when they are held at the position shown in FIG. 5 with the distance maximized between the back-up plate 16 and the finger tip 15*a* of each finger plate 15 then held at the projected position, the flow rate may be maximized. The extent to which the flow rate is adjustable depends on the amount of displacement, indicated by L in FIGS. 4 and 5, of the drive shaft 13 in either direction close towards or away from the back-up plate 16. The amount of displacement L of the drive shaft 13 in the direction close towards the back-up plate 16 may be chosen such that a complete occlusion of the tubing 17 takes place successively along the pumping section of the tubing 17 when each of the finger plates 15 is moved to the projected position and, on the other hand, the amount of displacement L of the drive shaft 13 in the direction away from the back-up plate 16 may be chosen such that a free flow of the liquid medium through the pumping section of the tubing 17 takes place at a rate determined by the pressure of the liquid medium flowing through the tubing 17, or the system head height, the bore size of the tubing 17, and/or the rotational speed of the drive shaft 13.

From the foregoing description of the present invention, it has now become clear that, even though the peristaltic pump assemblies as manufactured and/or assembled have a variation in pumping performance, such variation can be compensated for by the provision of at least one adjustment mechanism, i.e., by displacing the drive shaft in a direction parallel to the direction of movement of each finger plate and close towards or away from the back-up plate, thereby making it possible for all of the peristaltic pump assemblies to have a uniform pumping performance. Accordingly, when using the peristaltic pump assembly of the present invention, a doctor or nurse attendant to the patient need not take the variation in pumping performance into consideration and all he or she needs to take into consideration may be the rotational speed of the drive shaft, the bore size of the tubing actually used and the position of the source of the infusion solution.

Although the present invention has been described in connection with the preferred embodiment thereof with reference to the accompanying drawings, it is to be noted that various changes and modifications are apparent to those skilled in the art. By way of example, although each of the bearing plate 22 has been described and shown as having the inclined edges 22*c* and 22*d* inclined at the same angle relative to the longitudinal axis of the rectangular opening 21 and the wedge plates 23 and 24 have the respective inclined edges 23*c* and 24*c* which are therefore inclined at the same angle relative to the longitudinal axis of the rectangular opening 21, but in the opposite sense to each other, the inclined edges 22*c* and 22*d* may be inclined at different angles and, correspondingly, the inclined edges 23*c* and 24*c* may have different angles of inclination, but conforming to the inclination of the respective inclined edges 22*c* and 22*d*. However, the use of the same angle of inclination is preferred because the distance of movement of the bearing plate 22 and, hence, the distance of displacement of the drive shaft 13, can be maximized.

Also, the or each bearing plate 22 has been described as movable between the first and second positions past the neutral position intermediate therebetween. However, in the practice of the present invention, each of the adjustment mechanism may comprise a shaft bearing plate accommodated slidably in the rectangular opening 21 and a drive means for adjustably moving the shaft bearing plate in one direction.

Accordingly, such changes and modifications are to be understood as included within the scope of the present invention, as defined by the appended claims, unless they depart therefrom.

What is claimed is:

1. A peristaltic pump assembly for pumping a fluid medium from a fluid source through a tubing having a compressible pumping section, which assembly comprises:

a housing including at least one support wall;

a drive shaft journalled substantially loosely to the support wall;

a plurality of cam plates eccentrically mounted on the drive shaft in a helical pattern along the drive shaft and rotatable together with the drive shaft;

finger plates equal in number to the number of the cam plates and each having a finger tip engageable with the pumping section, said finger plates being operatively coupled with the cam plates such that the finger plates are successively and sequentially driven in a direction perpendicular to the drive shaft during a rotation of the drive shaft to cause the respective finger tips to engage the pumping section thereby producing a moving zone of occlusion along said pumping section for pumping the fluid medium; and an adjustment mechanism mounted on said support wall and comprising a shaft bearing plate mounted on said support wall for movement in a linear direction parallel to the direction of movement of each finger plate, said drive shaft extending rotatably through said shaft bearing plate, and a drive means for adjustably moving the bearing plate in said linear direction.

2. The peristaltic pump assembly as claimed in claim 1, wherein said support wall has a generally rectangular opening defined therein and having a longitudinal axis oriented in a direction conforming to the direction of movement of each finger plate and wherein said adjustment mechanism is operatively accommodated within said rectangular opening.

3. The peristaltic pump assembly as claimed in claim 2, wherein said shaft bearing plate is of a generally trapezoidal shape having a pair of parallel edges and a pair of inclined edges and wherein said drive means comprises first and second positioning wedge plates each having an inclined edge, said wedge plates being positioned on respective sides of the trapezoidal bearing plate with the respective inclined edges of said first and second wedge plates slidingly engaged with the associated inclined edges of the bearing plate, the inclined edge of each of the first and second wedge plate having a length smaller than that of any one of the inclined edges of the bearing plate.

4. The peristaltic pump assembly as claimed in claim 3, wherein the inclined edges of the trapezoidal bearing plates are inclined at the same angle, but in a sense opposite to each other.

5. The peristaltic pump assembly as claimed in claim 3, wherein said adjustment mechanism further comprises an adjustment bolt member for each of the wedge plates and extending through the support wall across the rectangular opening, at least a portion of said bolt member within the rectangular opening extending threadingly through the associated wedge plate to allow the latter to be adjustably moved as the bolt member is turned.

6. A peristaltic pump assembly for pumping a fluid medium from a fluid source through a tubing having a compressible pumping section, which assembly comprises:

a housing including a pair of support walls spaced apart from each other to define a cam chamber therebetween;

a drive shaft journalled substantially loosely to the support walls;

a plurality of cam plates eccentrically mounted within the cam chamber on the drive shaft in a helical pattern along the drive shaft and rotatable together with the drive shaft;

finger plates equal in number to the number of the cam plates and each having a finger tip engageable with the pumping section, said finger plates being operatively coupled with the cam plates within the cam chamber such that the finger plates are successively and sequentially driven in a direction perpendicular to the drive shaft during a rotation of the drive shaft to cause the respective finger tips to engage the pumping section thereby producing a moving zone of occlusion along said pumping section for pumping the fluid medium; and an adjustment mechanism mounted on each of said support walls and comprising a shaft bearing plate mounted on said support wall for movement in a direction parallel to the direction of movement of each finger plate, said driven shaft extending rotatably through said shaft bearing plate, and a driven means for adjustably moving the bearing plate in said direction parallel to the direction of movement of each finger plate.

7. The peristaltic pump assembly as claimed in claim 6, wherein said support wall has a generally rectangular opening defined therein and having a longitudinal axis oriented in a direction conforming to the direction of movement of each finger plate and wherein said adjustment mechanism is operatively accommodated within said rectangular opening.

8. The peristaltic pump assembly as claimed in claim 7, wherein said shaft bearing plate is of a generally trapezoidal shape having a pair of parallel edges and a pair of inclined edges and wherein said drive means comprises first and second positioning wedge plates each having an inclined edge, said wedge plates being positioned on respective sides of the trapezoidal bearing plate with the respective inclined edges of said first and second wedge plates slidingly engaged with the associated inclined edges of the bearing plate, the inclined edge of each of the first and second wedge plates having a length smaller than that of any one of the inclined edges of the bearing plate.

9. The peristaltic pump assembly as claimed in claim 8, wherein the inclined edges of the trapezoidal bearing plates are inclined at the same angle, but in a sense opposite to each other.

10. The peristaltic pump assembly as claimed in claim 8, wherein said adjustment mechanism further comprises an adjustment bolt member for each of the wedge plates and extending through the support wall across the rectangular opening, at least a portion of said bolt member within the rectangular opening extending threadingly through the associated wedge plate to allow the latter to be adjustably moved as the bolt member is turned.

* * * * *